US011479843B2

(12) United States Patent
Pohn et al.

(10) Patent No.: US 11,479,843 B2
(45) Date of Patent: Oct. 25, 2022

(54) METHOD FOR HARDENING A SINTERED COMPONENT

(71) Applicant: Miba Sinter Austria GmbH, Laakirchen (AT)

(72) Inventors: Manuel Pohn, Lenzing (AT); Markus Ludwig-Etzlstorfer, Marchtrenk (AT)

(73) Assignee: Miba Sinter Austria GmbH, Laakirchen (AT)

( * ) Notice: Subject to any disclaimer, the term of this patent is extended or adjusted under 35 U.S.C. 154(b) by 0 days.

(21) Appl. No.: 17/408,720

(22) Filed: Aug. 23, 2021

(65) Prior Publication Data

US 2022/0074036 A1 Mar. 10, 2022

(30) Foreign Application Priority Data

Sep. 10, 2020 (AT) ..... A 50766/2020

(51) Int. Cl.
*C23C 8/32* (2006.01)

(52) U.S. Cl.
CPC ..... *C23C 8/32* (2013.01)

(58) Field of Classification Search
CPC .... C23C 8/32; C23C 8/30; C23C 8/34; C21D 1/06
See application file for complete search history.

(56) References Cited

U.S. PATENT DOCUMENTS

| | | | |
|---|---|---|---|
| 7,112,248 | B2 | 9/2006 | Yamaguchi |
| 9,399,811 | B2 | 7/2016 | Schwarzer et al. |
| 2002/0166607 | A1 | 11/2002 | Altena et al. |
| 2017/0356077 | A1 | 12/2017 | Giraud et al. |

FOREIGN PATENT DOCUMENTS

| | | | |
|---|---|---|---|
| DE | 101 18 494 | A1 | 10/2002 |
| DE | 103 22 255 | A1 | 12/2004 |

OTHER PUBLICATIONS

A. Emamian, "A Study on Wear Resistance, Hardness and Impact Behaviour of Carburized Fe-Based Powder Metallurgy Parts for Automotive Applications," Materials Sciences and Applications, vol. 3 No. 8, 2012, pp. 519-522. doi: 10.4236/msa.2012.38073.*

* cited by examiner

*Primary Examiner* — Jessee R Roe
(74) *Attorney, Agent, or Firm* — Collard & Roe, P.C.

(57) ABSTRACT

A method for hardening a metal component includes the steps: hating the metal component to a first temperature between 750° C. and 1100° C.; increasing the carbon content in the metal component by applying a carbon donor gas to the metal component at the first temperature; cooling the metal component to a second temperature which is by 40° C. to 100° C. lower than the first temperature; increasing the nitrogen content in the metal component by applying a nitrogen donor gas to the metal component at the second temperature; cooling the metal component to ambient temperature, wherein a sintered component is used as the metal component and, after increasing the nitrogen content in the sintered component and prior to cooling the sintered component to ambient temperature, the sintered component is heated to a third temperature which is by 50° C. to 250° C. higher than the second temperature.

9 Claims, 2 Drawing Sheets

METHOD FOR HARDENING A SINTERED COMPONENT

CROSS REFERENCE TO RELATED APPLICATIONS

Applicant claims priority under 35 U.S.C. § 119 of Austrian Application No. A50766/2020 filed Sep. 10, 2020, the disclosure of which is incorporated by reference.

BACKGROUND OF THE INVENTION

1. Field of the Invention

The invention relates to a method for hardening a metal component comprising the steps: heating the metal component to a first temperature between 750° C. and 1100° C.; increasing the carbon content in the metal component by applying a carbon donor gas to the metal component at the first temperature; cooling the metal component to a second temperature which is by 40° C. to 100° C. lower than the first temperature; increasing the nitrogen content in the metal component by applying a nitrogen donor gas to the metal component at the second temperature; cooling the metal component to ambient temperature.

The invention further relates to a sintered component made from a chromium-free sintering steel.

2. Description of the Related Art

Low-pressure carbonitriding of steel components made of solid materials is a well-known method for improving the mechanical properties of such components. For example, DE 101 18 494 A1 describes a method for low-pressure carbonitriding of steel components, in which the components, in a temperature range of approximately 780° C. to 1050° C., are first carbonized using a carbon donor gas at a partial pressure below 500 mbar within at least one evacuable treatment chamber and then nitrided using a nitrogen donor gas. At the end of the carburizing phase or after cooling to a temperature range of about 780° C. to 950° C., a nitrogen donor gas containing ammonia is admitted into the at least one treatment chamber starting from a vacuum to a partial pressure of the nitrogen donor gas of less than 1000 mbar, in order to nitride the components.

For sintering materials not containing chromium, this method—as well as other methods—is not applicable or applicable merely in a limited manner, since mixed structures (carbide formation, bainite formation, etc.) and hardness losses or insufficient hardening occur.

SUMMARY OF THE INVENTION

It is the object of the present invention to provide a hardened sintered component.

The object of the invention is achieved by the initially mentioned method, according to which it is provided that a sintered component is used as the metal component and that after increasing the nitrogen content in the sintered component and prior to cooling the sintered component to ambient temperature, the sintered component is heated to a third temperature which is by 50° C. to 250° C. higher than the second temperature.

Moreover, the object of the invention is achieved by the initially mentioned sintered component which is produced according to the method according to the invention and has a minimum density of 7.0 g//cm$^3$.

By incorporating nitrogen, the hardening capacity of the sintered component is improved, whereby a higher surface hardness may be achieved. In this regard, by repeated heating to the third temperature, a mixed structure is prevented by formed carbides being dissolved at least largely. In addition to the "carbide-free" heat treatment, another advantage is that a controlled hardness profile can be formed. Moreover, hardly any warping of the sintered components is observed with the method. The method is also applicable for densities of the sintered components of more than 7.0 g/cm$^3$, in particular more than 7.25 g/m$^3$. Although the method steps are largely known for solid materials made of steel, as stated above, the variation of this method according to the invention would not be applied to steel components made of solid materials, since the additional heating of such steel components would result in grain coarsening and thus in a quality reduction due to a loss of solidity. An excessively high content of carbon in the edge region would lead to edge embrittlement in solid material components.

For further improvement of the aforementioned effects, according to an embodiment variant of the invention, it may be provided that the sintered component, after heating to the third temperature and prior to cooling the sintered component to ambient temperature, is heated to a fourth temperature which is by 10° C. to 70° C. higher than the third temperature, and/or that the sintered component is heated to at least 950° C. as the third temperature or as the fourth temperature.

As already indicated above, the method according to the invention, according to a further embodiment variant, is preferably applied to chromium-free sintered component with a minimum density of 7.0 g/cm$^3$, in particular to sintered components made of a chromium-free sintering steel. By avoiding chromium, the powders used are easier to press and/or the sintered components produced are easier to form, for example to compact. Thus, a sintered component may be produced which can be more easily pressed to a higher density and which has surface hardening. Together, these measures result in sintered components with a relatively high mechanical load-bearing capacity.

According to a further embodiment variant of the invention, it may be provided for the formation of a more uniform carbonized edge region that the carbon donor gas is fed in the form of gas pulses.

According to a further embodiment variant of the invention, it may be provided that a nitrogen hydrogen compound, in particular ammonia or an amine, is used as the nitrogen donor gas, whereby not only the required nitrogen may be provided in a well manageable way, but which also makes it easier to maintain a reducing atmosphere. Hence, hard oxide phases may better be prevented.

For further improvement of the mechanical properties, according to another embodiment variant of the invention, it may be provided the sintered component is compacted, in particular surface-compacted, prior to and/or after hardening. By the compaction prior to hardening, due to the reduction of the number of pores and the pore size, the subsequent diffusion processes can be influenced, which in turn can influence the hardening itself. The surface compaction after hardening may also contribute to a further improvement of the mechanical parameters of the sintered component.

According to another embodiment variant of the invention, it may be provided that a sintered component is produced which has a hardened edge layer with a carbon gradient and/or a nitrogen gradient, wherein the hardened edge layer has a layer thickness of between 0.1 μm and 1500 μm.

By means of the method according to the invention, according to a further embodiment variant, a sintered component may be produced more easily, which has at least one region having a density differing from that of the remaining regions, or which has a uniform density distribution.

For the purpose of better understanding of the invention, it will be elucidated in more detail by means of the figure below.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

These show in schematic representation.

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 2:
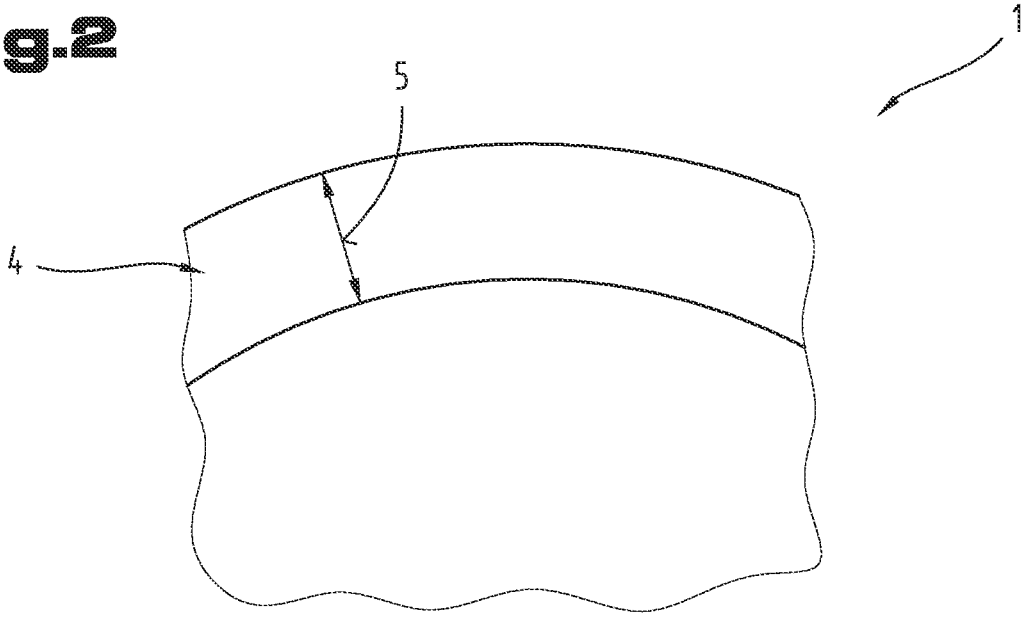
FIG. 2 shows a section of a sintered component.

As explained above, the invention relates to a method for hardening a sintered component 1, a section of which is shown in FIG. 2.

The production itself of such sintered components 1 is known, such that further explanations in this regard may be dispensed with. It should only be mentioned that these processes include the steps of powder pressing and sintering. Sintering may be carried out in multiple stages. Optionally, post-processing of the sintered component 1 may be carried out after sintering, such as the calibration of the sintered component 1, or the subsequent compression of the sintered component 1, or machining of the sintered component 1. With respect to the further details in this regard, such as pressure forces etc., reference is made to the relevant prior art.

The powders used to produce the sintered component 1 according to the invention are conventional metallic powders, which may optionally contain ceramic hard particles and/or processing aids, such as pressing aids and/or binders, etc.

In general, any metallic powders that may be hardened by the method, in particular on an iron basis, such as steels or ferrous alloys, may be used. However, in the preferred embodiment variant of the invention, a metallic powder is used which is free of chromium. In particular, said chromium-free powder may be a sintering steel or a ferrous alloy, wherein this preferred powder preferably contains molybdenum.

Examples for such powders are:

- Fe (pre-alloyed with 0.85 wt. % Mo)+0.1 wt. %-0.3 wt. % C+0.2 wt. %-1.0 wt. % pressing aid and possibly binding agent;
- Fe+1 wt. %-3 wt. % Cu+0.5 wt. %-0.9 wt. % C+0.2 wt. %-0.8 wt. % pressing aid and possibly binding agent;
- 18 wt. % Mn+2.5 wt. % Al+3.5 wt. % Si+0.5 wt. % V+0.3 wt. % B, remainder Fe, pressing aid and possibly binding agent;
- 24 wt. % Mn+3 wt. % Al+2.5 wt. % Si, remainder Fe, pressing aid and possibly binding agent;
- 14 wt. % Mn, 5 wt. % Ni+3 wt. % Al+3 wt. % Si, remainder Fe, pressing aid and possibly binding agent.

However, further compositions common in sintering technology may also be used.

In general, the metallic sintering powder from which the sintered component 1 is produced may be an iron-base powder, which contains up to 15 wt. %, in particular up to 10 wt. %, of non-iron metals, of which up to 2 wt. % are formed by molybdenum and the remainder up to 15 wt. % is formed by the metals manganese, copper, aluminum, magnesium, boron, nickel, phosphorus, tungsten, titanium, vanadium, and the remainder iron and optionally processing aids such as pressing aids and/or binding agents. The proportion of pressing aid may amount to up to 2.5 wt. %, in particular 2 wt. %, and the proportion of binding agent may amount to up to 0.75 wt. %, in particular 0.5 wt. %.

A so-called green compact is pressed from the powder. In this regard, any warpages or shrinkages that may occur or an increase in dimensions are already taken into account during sintering. The sintered components 1 may also be produced in net shape or near net shape quality.

In general, the sintered component 1 may be designed as desired. For example, the sintered components 1 may be a gear, a connecting rod, a bearing cap for a split bearing assembly, an internal gear, a sliding sleeve, a ball ramp (especially a ball ramp actuator), a VVT component, a cam wheel, etc.

The green compact is subsequently sintered in one or multiple stages and subjected to the hardening method according to the invention in the sintered state, or it is used as such in the hardening method according to the invention and sintered during the course of the method. However, it is also possible that the green compact is pre-sintered to a brown compact and finally sintered in the course of the method according to the invention. The term "sintered component", which is used in the method according to the invention, thus comprises the green compact, the brown compact and the final sintered component. Preferably, the sintered component 1 is used in the method according to the invention in its final sintered state.

Figure 1:
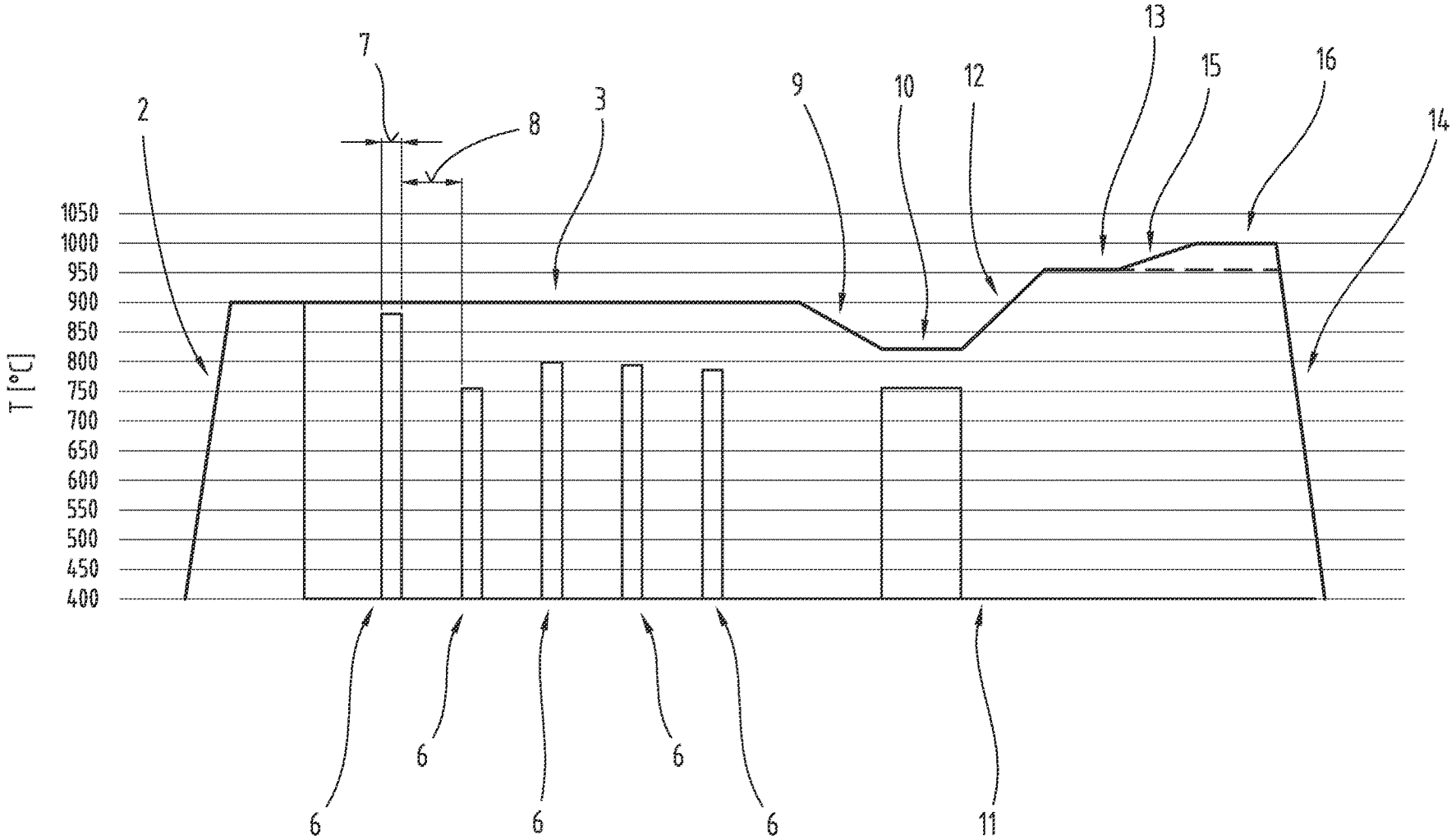
FIG. 1 shows a temperature progression for heat treatment of a sintered component.

With regard to FIG. 1, a temperature progression across time may be seen therein, wherein the temperature is indicated on the ordinate in [° C.].

The temperatures indicated below refer to the temperature in the heat treatment device (=machine parameters, i.e. the temperature measured in the furnace space). The surface temperature of the sintered component 1 may correspond to this temperature (depending on the dwell time of the sintered component in the heat treatment device). The sintered component 1 may have the respective indicated temperature merely in an edge zone adjoining the surface or in its entirety.

At the beginning of the method, the sintered component 1 is heated to a first temperature using a heating ramp, as can be seen in FIG. 1 in the heating section 2. In the context of the description of FIG. 1, the term "section" refers merely to the temperature curve and not to a section in a device in which the method is carried out.

As a device, for example, a device described in the initially mentioned document DE 101 18 494 A1 may be used. However, other suitable device may also be used for carrying out the method. Preferably, the device for carrying out the method operates in batch mode.

Heating in the heating section 2 may be carried out at a continuous heating rate, in particular a heating rate of between 0.01 K/s and 10 K/s. Heating may be performed with a linear heating rate, as is shown in FIG. 1. However, other heating rates may also be applied, such as a step-shaped or a curve-shaped one.

In the heating section 2, the sintered component 1 is heated to a first temperature which amounts to between 750° C. and 1100° C., in particular to between 850° C. and 1000° C.

The sintered component 1 is heated in the heating section 2 preferably at normal pressure, i.e. at approx. 1013 mbar, depending on the respective prevailing air pressure at the location where the method is carried out. However, it is also possible that the pressure in the treatment chamber of the device, in which the method is carried out, is reduced already in this heating section 2, such that heating the sintered component 1 may thus be carried out already at the reduced pressure.

In a carburization section 3, which adjoins, in particular directly adjoins, the heating section 2, the carburization of the sintered component 1, i.e. the increase of the carbon content in an edge layer 4 (see FIG. 2) of the sintered component 1, is carried out.

The edge layer 4 may have a layer thickness 5, measured from the surface of the sintered component 1, which is selected from a range of 0.1 μm to 1500 μm. In this regard, the thickness of the edge layer 4 depends, inter alia, on the treatment duration and the partial pressure of a carbon donor gas in the treatment chamber.

For carrying out the carburization of the sintered component 1, the pressure in the treatment chamber is reduced, i.e. low-pressure carburization is carried out. In this regard, the pressure in the carburization section 3 is reduced to a value (chamber pressure) selected from a range of $10^{-2}$ mbar, in particular $10^{-3}$ mbar, to $10^{-6}$ mbar, in particular $10^{-5}$ mbar. The pressure reduction in the treatment chamber may be carried out already at the beginning of the carburization section 3. In the alternative or in addition to this, the pressure reduction may also start/be carried out already during heating. However, it is also possible to carry out the reduction of the pressure only after the beginning of the carburization section 3, for example after the expiration of a period of 1 minute to 240 minutes from the beginning of the carburization section 3.

For example, methane, ethane, acetylene, propane, or the like, as well as mixtures thereof, may be used as the carbon donor gas. The partial pressure of the carbon donor gas in the treatment chamber may amount to between 0 mbar and 1000 mbar, in particular between 0.1 mbar and 1000 mbar. In this context, said pressure is the prevailing pressure of the carbon donor gas during its introduction. Due to the consumption of the carbon donor gas in consequence of the carburization of the sintered component 1, this pressure decreases in the course of the method section.

For example, the volume flow of the carbon donor gas may amount to between 1 l/h and 10000 l/h.

During carburization and/or in the carburization section 3, the temperature is preferably kept constantly at the first temperature (within the control tolerances of the device).

The carburization section 3 is preferably carried out across a timespan which is selected from a range of 10 minutes to 600 minutes.

In the carburization section 3, the carbon content in the sintered component 1 at least in the edge layer 3 is increased by a value of between 0.01 wt. %, in particular 0.1 wt. %, and 1.2 wt. %. Thus, after carburization, the sintered component 1 may have a carbon content of between 0.2 wt. % to 1.4 wt. % (taking into consideration the initial carbon content).

It is possible that the introduction of the carbon donor gas is started when the desired chamber pressure is achieved. However, the introduction of the carbon donor gas may also be carried out only at a later point in time during the carburization section 3.

Moreover, it is possible that the carbon donor gas is continuously fed until the end of the carburization section. However, in the preferred embodiment variant of the method, the carbon donor gas is fed in the form of gas pulses 6, as is indicated in FIG. 1. This means that the carbon donor gas is fed merely for a specific timespan 7 and a timespan 8 without the carbon donor gas being fed follows. Thus, a sequence of timespans 7 with carbon donor gas being fed and timespans 8 without carbon donor gas being fed may be carried out during the carburization section 3.

The timespan 7 in which carbon donor gas is fed may last for between 5 second and 1200 seconds.

The timespan 8 without carbon donor gas being fed may last for between 0.5 minutes and 600 minutes.

FIG. 1 shows five gas pulses 6. However, this number is not to be considered restricting. Rather, the number of gas pulses 6 during the carburization section 3 may amount to between 1 and 20.

As can be seen from FIG. 1, the gas pulses 6 may be designed differently. For example, they may be performed at different partial pressures (within the aforementioned range). This is indicated in FIG. 1 by the different heights of the gas pulses 6. Alternatively or additionally to this, the gas pulses 6 may also have different durations (within the range mentioned above for the duration of the gas pulses 6). In this regard, it is preferred for the largest amount (the largest volume) of carbon donor gas to be fed with the first gas pulse 6 (leftmost gas pulse 6 in FIG. 1). The gas pulse 6 with which the smallest amount (the smallest volume) of carbon donor gas is fed may follow immediately. Thus, the fact that the consumption of carbon donor gas is largest at the beginning of the carburization is taken into account.

Of course, other courses of different gas pulses 6 are also possible.

However, the gas pulses 6 may also all be formed equally.

Preferably, the last gas pulse 6 does not coincide with the end of the carburization section 3.

Following, in particular immediately following, the carburization section 3, cooling of the sintered component 1 is carried out in a cooling section 9. Therein, the temperature of the sintered component 1 is lowered to a second temperature which is by 40° C. to 100° C. lower than the first temperature.

Cooling is in particular carried out using a cooling ramp. In this context, the sintered component 1 is cooled preferably at a cooling rate of 0.1 K/minute to 100 K/minute.

Cooling may be performed by gas quenching (e.g. with nitrogen, helium or hydrogen).

A nitriding section 10, in particular immediately, follows the cooling section 9.

The increase of the nitrogen content in the sintered component 1 is carried out in the nitriding section 10. Due to this section, the method is a carbonitriding method.

It should be noted at this point that the entire method is carried out at reduced pressure. For the sake of clarity, a pressure curve 11 is indicated in FIG. 1. In this regard, the pressure in the treatment chamber is naturally increased by the introduction of the carbon donor gas and the nitrogen donor gas. However, preferably, no excess pressure but at maximum the aforementioned normal pressure is achieved by this.

According to a preferred embodiment variant of the method, a nitrogen hydrogen compound, in particular ammonia or an amine, such as methylamine, is used as the nitrogen donor gas. However, other nitrogen donor gases, such as dimethylamine, as well as mixtures of different nitrogen donor gases, may also be used.

The partial pressure of the nitrogen donor gas in the treatment chamber may amount to between 0 mbar and 1000 mbar, in particular 0.1 mbar and 1000 mbar. In this context, said pressure is the prevailing pressure of the nitrogen donor gas during its introduction. Due to the consumption of the nitrogen donor gas in consequence of the nitriding of the sintered component 1, this pressure decreases in the course of the method section.

For example, the volume flow of the nitrogen donor gas may amount to between 1 l/h and 10000 l/h.

During nitriding and/or in the nitriding section 10, the temperature is preferably kept constantly at the second temperature (within the control tolerances of the device). The nitriding section 10 may also take place during the temperature reduction.

The nitriding section 10 is preferably carried out across a timespan which is selected from a range of 60 minutes to 600 minutes.

In the nitriding section 10, the nitrogen content in the sintered component 1 at least in the edge layer 4 is increased by a value of between 0.01 wt. %, in particular 0.1 wt. %, and 2 wt. %. Thus, after nitriding, the sintered component 1 may have a nitrogen content of between 0.01 wt. %, in particular 0.1 wt. %, and 2 wt. %.

It is possible that the introduction of the nitrogen donor gas is started when the second temperature is reached. However, the introduction of the nitrogen donor gas may also be carried out only at a later point in time during the nitriding section 10.

The nitrogen donor gas may be introduced into the treatment chamber during the entire duration of the nitriding section 10 or merely in a partial section thereof. It is also possible that the nitrogen donor gas is fed in pulses, as has been described with respect to the gas pulses 6 of the carbon donor gas. The corresponding statements made in this regard may optionally also be applied to the nitrogen donor gas.

Before the sintered component 1 is cooled back to ambient temperature (20° C.) and removed from the device for carrying out the method, it is provided that the sintered component 1 is heated again. For this purpose, a further heating section 12 follows, in particular immediately follows, the nitriding section 10.

Heating in the further heating section 12 may be carried out at a heating rate of between 0.01 K/s and 10 K/s. Heating may be performed with a linear heating rate, as is shown in FIG. 1. However, other heating rates may also be applied, such as a step-shaped or a curve-shaped one.

In the further heating section 12, the sintered component 1 is heated to a third temperature which is by 50° C. to 250° C. higher than the second temperature.

Following, in particular immediately following, this further heating section 12, there is a maintaining section 13 in which the third temperature is kept constant (within the control tolerances of the device).

This maintaining section 13 may extend across the entire timespan until cooling of the sintered component 1 to ambient temperature, as is partially shown in dashed lines in FIG. 1.

The entire duration between the heating section 12 and a further cooling section 14, in which the sintered component is cooled to ambient temperature, may amount to between 5 minutes and 600 minutes.

However, according to an embodiment variant of the method, it may also be provided that the sintered component 1, after heating to the third temperature and prior to cooling of the sintered component 1 to ambient temperature, is heated to a fourth temperature which is by 10° C. to 100° C. higher, than the third temperature, in a third heating section 15.

Heating in the third heating section 15 may be carried out at a heating rate of between 0.1 K/s and 10 K/s. Heating may be performed with a linear heating rate, as is shown in FIG. 1. However, other heating rates may also be applied, such as a step-shaped or a curve-shaped one.

The fourth temperature may be kept constant in a further maintaining section 16 until the sintered component 1 is cooled in the further cooling section 14 (within the control tolerances of the device).

Thus, it is possible in the context of the invention that the duration between the further heating section 12 and the further cooling section 14 is distributed to multiple different temperatures in maintaining sections 13, 16 each with a constant temperature.

The distribution of the aforementioned entire duration to the maintaining sections 13, 16 may be between 1:1 and 1:3.

However, it is also possible that for the entire duration merely the first maintaining section 13 is present at a constant temperature and that subsequently, the temperature of the sintered component 1 is increased at a heating rate until the further cooling section 14. In this regard, the heating may be selected from the range mentioned with regard to the third heating section 15 and may optionally vary across the duration between the maintaining section 13 and the further cooling section 14. Moreover, it is possible that no maintaining section 13, 16 with a constant temperature is present between the nitriding section 10 or the further heating section 12 and the further cooling section 14, but that the temperature of the sintered component 1 is continuously heated at a heating rate until the further cooling section 14. In this regard, the heating rate may be selected from a range of 0.1 K/s to 10 K/s. In this regard, it may optionally be provided that the sintered component 1 is heated at multiple different heating rates which are all selected from the mentioned range.

In this timespan between the nitriding section 10 and/or the further heating section 12 and the further cooling section 14, the dissolution of carbides formed during the method takes place, as has been explained above.

In the further cooling section 14, the sintered component 1 is cooled from the third temperature or the fourth temperature to ambient temperature. Cooling may be carried out at a cooling rate of 0.1 K/s to 50 K/s. Cooling can, for example, be performed by gas quenching (e.g. with nitrogen, helium or hydrogen).

According to a further embodiment variant of the method, it may be provided that the sintered component 1 is heated to at least 950° C., in particular to a temperature between 1000° C. and 1150° C., as the third temperature or as the fourth temperature.

According to another embodiment variant, it may also be provided that the sintered component 1 is surface-compacted in the described process before and/or after hardening. The surface compaction may be carried out, for example, by pressing, rolling, etc.

Moreover, according to another embodiment variant of the method, it may be provided that this method is designed such (in the context of the processes described above) that a sintered component 1 is produced which comprises a hardened edge layer 4 with a carbon gradient and/or a nitrogen gradient, wherein the hardened edge layer 4 has the layer thickness described above.

In this regard, the carbon gradient may be designed such that the carbon content in the sintered component 1 starting out from its surface decreases from a value of 1.5 wt. % across the layer thickness 5 of the edge layer 4 to a value of 0.1 wt. %. In this regard, the decrease may be linear, exponential or logarithmic.

The nitrogen gradient may be designed such that the nitrogen content in the sintered component 1 starting out from its surface decreases from a value of 2 wt. % across the layer thickness 5 of the edge layer 4 to a value of 0 wt. %. In this regard, the decrease may be linear, exponential or logarithmic.

In another embodiment variant of the method, it is provided that the sintered component 1 is produced having at least one region which has a density differing from that of the remaining regions. In this regard, said regions may be formed so as to immediately adjoin one another in the radial direction or in the axial direction. This may be achieved, for example, by creating different porosities.

Merely for the sake of completeness, it should be noted that the device for carrying out the method comprises at least one treatment chamber, at least one extraction line for generating the vacuum in the treatment chamber, and at least one feed line for introducing the carbon donor gas and/or the nitrogen donor gas. Besides this, devices for heating and/or cooling the sintered component 1 may be present. Moreover, corresponding closed-loop controller devices, in particular for controlling the temperature while the method is carried out, may be present. Further extensions or installations are of course possible.

Moreover, it should be noted that of course multiple sintered components 1 may be subjected to the method in the treatment chamber of the device at the same time.

To evaluate the method, examples with the following parameters have been carried out.

Sintered components 1 made of a chromium-free sintering steel powder were heated at a heating rate of between 0.05 K/s and 1.5 K/s to a temperature of between 800° C. and 1070° C. in the heating section 2. Subsequently, this temperature has been kept constant for 1 hour to 6 hours in the carburization section 3. During this timespan, between one and 20 gas pulses 6 have been emitted, wherein the gas pulses 6 had a duration of 1 minute to 10 minutes. Methane was used as the carburization gas. The timespan 8 between the gas pulses was between 1 minute and 30 minutes. After the carburization section 3, the sintered components 1 were cooled at a cooling rate of between 0.1 K/s and 50 K/s in the cooling section 9 to a temperature which is by 40° C. to 100° C. lower than the temperature in the carburization section 3. In the nitriding section 10, methylamine was fed for a duration of 60 minutes to 300 minutes. Subsequently, the sintered components 1 were heated in the heating section 12 at a heating rate of between 0.05 K/s and 1.5 K/s to a temperature in the maintaining section 13 which is by 50° C. to 250° C. higher than the temperature in the carburization section 3. In the further heating section 15, the sintered components 1 were heated at a heating rate of between 0.05 K/s and 1.5 K/s to a temperature of the maintaining section 16 which is higher by a temperature between 0° C. and 100° C. than the temperature in the maintaining section 13. Lastly, the sintered components 1 were cooled to ambient temperature in the cooling section 14 at a cooling rate of between 0.1 K/s and 50 K/s.

The pressure during performance of the method was between $10^{-3}$ and $10^{-6}$ mbar (pressure curve 11) as of the beginning of the carburization section 3.

Nitriding in the nitriding section 10 was performed within a time of between 60 minutes and 300 minutes.

After this, the sintered components 1 had an edge layer 4 with a carbon content increased by 0.01 wt. % to 1.2 wt. % and a nitrogen content increased by between 0.01 wt. % and 2 wt. %, the layer thickness 5 of which was between 0.01 mm and 1.5 mm.

The exemplary embodiments show and/or describe possible embodiment variants, while it should be noted at this point that combinations of the individual embodiment variants are also possible.

Finally, as a matter of form, it should be noted that the figures are not necessarily depicted to scale.

Although only a few embodiments of the present invention have been shown and described, it is to be understood that many changes and modifications may be made thereunto without departing from the spirit and scope of the invention.

| List of reference numbers | |
|---|---|
| 1 | Sintered component |
| 2 | Heating section |
| 3 | Carburization section |
| 4 | Edge layer |
| 5 | Layer thickness |
| 6 | Gas pulse |
| 7 | Timespan |
| 8 | Timespan |
| 9 | Cooling section |
| 10 | |
| 11 | Nitriding section |
| 12 | Pressure curve |
| 13 | Heating section |
| 14 | Maintaining section |
| 15 | Cooling section |
| 16 | Heating section |
| 17 | Maintaining section |

What is claimed is:

1. A method for hardening a metal component comprising the steps:

heating the metal component to a first temperature between 750° C. and 1100° C.;

increasing the carbon content in the metal component by applying a carbon donor gas to the metal component at the first temperature;

cooling the metal component to a second temperature which is by 40° C. to 100° C. lower than the first temperature;

increasing the nitrogen content in the metal component by applying a nitrogen donor gas to the metal component at the second temperature; and cooling the metal component to ambient temperature;

wherein a sintered component (1) is used as the metal component and wherein after increasing the nitrogen content in the sintered component (1) and prior to cooling the sintered component (1) to ambient temperature, the sintered component (1) is heated to a third temperature which is by 50° C. to 250° C. higher than the second temperature.

2. The method according to claim 1, wherein the sintered component (1), after heating to the third temperature and prior to cooling of the sintered component (1) to ambient temperature, is heated to a fourth temperature which is by 10° C. to 70° C. higher than the third temperature.

3. The method according to claim 1, wherein the sintered component (1) is heated to at least 950° C. as the third temperature or as the fourth temperature.

4. The method according to claim 1, wherein a chromium-free sintered component (1) is used, in particular a sintered component (1) made of a chromium-free sintering steel.

5. The method according to claim 1, wherein the carbon donor gas is fed in the form of gas pulses (6).

6. The method according to claim 1, wherein a nitrogen hydrogen compound, in particular ammonia or an amine, is used as the nitrogen donor gas.

7. The method according to claim 1, wherein the sintered component (1) is compacted, in particular surface-compacted, prior to and/or after hardening.

8. The method according to claim 1, wherein a sintered component (1) is produced which has a hardened edge layer (4) with a carbon gradient and/or a nitrogen gradient, wherein the hardened edge layer (4) has a layer thickness (5) of between 0.1 μm and 1500 μm.

9. The method according to claim 1, wherein the sintered component (1) is produced having at least one region which has a density differing from that of the remaining regions.

* * * * *